United States Patent [19]

Nakajima et al.

[11] Patent Number: 4,776,770

[45] Date of Patent: Oct. 11, 1988

[54] VARIABLE CAPACITY VANE COMPRESSOR

[75] Inventors: Nobuyuki Nakajima; Kenichi Inomata; Shigeru Okada; Kazuo Eitai; Masaya Moruta; Toshio Yamaguchi, all of Konan, Japan

[73] Assignee: Diesel Kiki Co., Ltd., Tokyo, Japan

[21] Appl. No.: 131,990

[22] Filed: Dec. 11, 1987

[30] Foreign Application Priority Data

Dec. 19, 1986 [JP] Japan ..... 61-195582[U]
Mar. 9, 1987 [JP] Japan ..... 62-53268

[51] Int. Cl.[4] ..... F04B 49/00; F04B 49/02; F04C 29/08

[52] U.S. Cl. ..... 417/295; 417/310

[58] Field of Search ..... 417/295, 310; 418/78

[56] References Cited

U.S. PATENT DOCUMENTS 3,185,105 5/1965 Headings et al. ..... 91/482
4,726,740 2/1988 Suzuki ..... 417/310

FOREIGN PATENT DOCUMENTS 62-20688 1/1987 Japan .
62-132289 8/1987 Japan .

*Primary Examiner*—William L. Freeh
*Attorney, Agent, or Firm*—Frishauf, Holtz, Goodman & Woodward

[57] ABSTRACT

A variable capacity vane compressor in which one of front and rear side blocks has at least one inlet port divided into first and second portions, and a control element has at least one pressure-receiving protuberance dividing a space formed in the one side block into first and second pressure chambers, wherein the control element angularly moves in response to a differential pressure between the first and second pressure chambers, to vary the opening angle of the second portion of the at least one inlet port. A torsion coiled spring is fitted around a hub of the one side block for biasing the control element in a circumferential direction of increasing the opening angle of the second portion of the inlet port. The torsion coiled spring has an end thereof provided with a first engaging portion engaging a first retaining device provided in the control element, and another end thereof provided with a second engaging portion engaging a second retaining device provided in the hub, through a holding device. The second engaging portion of the spring comprises a first portion and a second portion extending at a predetermined angle with respect to the first portion and forming a tip, thus presenting a bent portion together with the first portion. The second retaining device of the hub comprises a first retaining portion engaging the first portion of the second engaging portion of the spring, and a second retaining portion extending at a predetermined angle with respect to the first retaining portion and engaging the second portion of the second engaging portion of the spring.

16 Claims, 15 Drawing Sheets

VARIABLE CAPACITY VANE COMPRESSOR

BACKGROUND OF THE INVENTION

This invention relates to variable capacity vane compressors which are adapted for use as refrigerant compressors of air conditioners for automotive vehicles, and more particularly to variable capacity vane compressors of this kind in which the timing of commencement of compression is varied to thereby control the capacity of the compressor.

Such a variable capacity vane compressor is known e.g. by Japanese Provisional Patent Publication (Kokai) No. 62-20688 assigned to the same assignee of the present application. The above conventional vane compressor basically comprises a cylinder formed of a cam ring and a pair of side blocks closing opposite ends of the cam ring, one of the front and rear side blocks having at least one first inlet port formed therein; a rotor rotatably received within the cylinder; a plurality of vanes radially slidably fitted in respective slits formed in the rotor; wherein compression chambers are defined between the cylinder, the rotor and adjacent ones of the vanes and vary in volume with rotation of the rotor for effecting suction of a compression medium from the suction chamber into the compression chambers through the at least one first inlet port, and compression and discharge of the compression medium; at least one second inlet port formed in the on of the front and rear side blocks which has the at least one first inlet port formed therein; a pressure chamber formed in the one of the front and rear side blocks and communicating with a zone under lower pressure and a zone under higher pressure; a control element angularly displaceably fitted within an annular recess formed in the one of the front and rear side blocks, for controlling the opening angle of the at least one second inlet port, the control element having a pressure receiving portion slidably fitted in the pressure chamber and dividing the pressure chamber into a first pressure chamber communicating with the zone under lower pressure and a second pressure chamber communicating with both the zone under lower pressure and the zone under higher pressure chamber; the control element being angularly displaceable in response to a difference in pressure between the first and second chambers for causing the control element to vary the opening angle of the second inlet port, to thereby cause a change in the timing of commencement of the compression of compression medium and hence vary the capacity of the compressor; and a biasing member loosely fitted around a hub projecting integrally from the one of the side blocks at one end face remote from the rotor, for biasing the control element in a direction of increasing the opening angle of the at least one second inlet port.

However, according to this conventional vane compressor, the biasing member is formed by a torsion coiled spring, for example, which has a coiled body thereof fitted around the hub projecting integrally from the one of the side blocks at one end face remote from the rotor, with one end thereof engaged with the control element and the other end engaged thereof with the hub, respectively. With such arrangement, the coiled body of the torsion coiled spring can have loops thereof brought into contact with each other, or can be brought into contact with the outer peripheral surface of the hub since the ends of the torsion coiled spring are loosely supported by the control element and the hub of the one side block, thus undesirably causing a frictional force. This frictional force possibly results in a hysteresis between deformation of the torsion coiled spring toward its tensioned position and resumption of same back to its relaxed position, thereby making it difficult to accurately control the control element and hence the capacity of the compressor.

SUMMARY OF THE INVENTION

It is an object of the present invention to provide a variable capacity vane compressor in which a torsion coiled spring for biasing a control element is firmly supported such that it is free from loops thereof being brought into contact with each other, and at the same time, frictional resistance caused by contact of the torsion coiled spring with its peripheral parts is reduced, thereby improving the capacity controllability of the compressor.

It is another object of the invention to provide a variable capacity vane compressor in which frictional resistance caused by contact of a torsion coiled spring with its peripheral parts is reduced, thereby improving the capacity controllability of the compressor, without the size of the compressor being enlarged.

According to the present invention, there is provided a variable capacity vane compressor comprising:

a cylinder formed by a cam ring and a pair of front and rear side blocks respectively closing opposite axial ends of the cam ring, one of the front and rear side blocks having at least one inlet port, the at least one inlet port having a first portion and a second portion, the one side block having a recess formed therein and a hub extending integrally from an end face thereof;

a rotor rotatably received within the cylinder;

a plurality of vanes radially slidably fitted in slits formed in the rotor;

a zone under low pressure;

a zone under high pressure;

the cylinder, the rotor and adjacent ones of the vanes cooperating with each other to define therebetween a plurality of compression chambers which vary in volume, as the rotor rotates, so that a compression medium is drawn into at least one of the compression chambers which is on a suction stroke from the zone under low pressure chamber through the at least one inlet port, and the drawn medium is compressed within at least one of the compression chambers which is on a compression stroke and is discharged therefrom;

the second portion of the at least one inlet port communicating with the zone under low pressure and at least one of the compression chambers which is on a suction stroke;

at least one space provided in the one side block and communicating with the zone under low pressure and the zone under high pressure;

a control element angularly displaceably fitted in the recess for controlling the opening angle of the second portion of the at least one inlet port;

the control element having a pressure receiving portion slidably fitted in the at least one space and dividing the space into a first pressure chamber communicating with the zone under low pressure and a second pressure chamber communicating with both the zone under low pressure and the zone under high pressure;

a torsion coiled spring fitted around the hub of the one side block for biasing the control element in an angular direction of increasing the opening angle of the second portion of the at least one inlet port;

the control element being angularly displaceable in response to a difference between the sum of pressure in the first pressure chamber and the force of the torsion coiled spring and pressure in the second pressure chamber for causing the control element to vary the opening angle of the second portion of the at least one inlet port, to thereby cause a change in the timing of commencement of the compression of the compression medium and hence vary the capacity of the compressor;

the torsion coiled spring having one end thereof provided with a first engaging portion, and another end thereof provided with a second engaging portion;

first retaining means provided in the control element and engaging the first engaging portion of the torsion coiled spring;

second retaining means provided at the hub of the one side block and engaging the second engaging portion of the torsion coiled spring; and holding means for holding the second engaging portion of the torsion coiled spring engaging the second retaining means;

the second engaging portion of the torsion coiled spring comprising a first portion and a second portion extending at a predetermined angle with respect to the first portion and forming a tip of the torsion coiled spring, the first and second portions presenting together a bent portion;

the second retaining means of the hub comprising a first retaining portion engaging the first portion of the second engaging portion of the torsion coiled spring, and a second retaining portion extending at a predetermined angle with respect to the first retaining portion and engaging the second portion of the second engaging portion of the torsion coiled spring.

The above and other objects, features and advantages of the invention will be more apparent from the ensuing detailed description taken in conjunction with the accompanying drawings.

DETAILED DESCRIPTION

Figure 1:
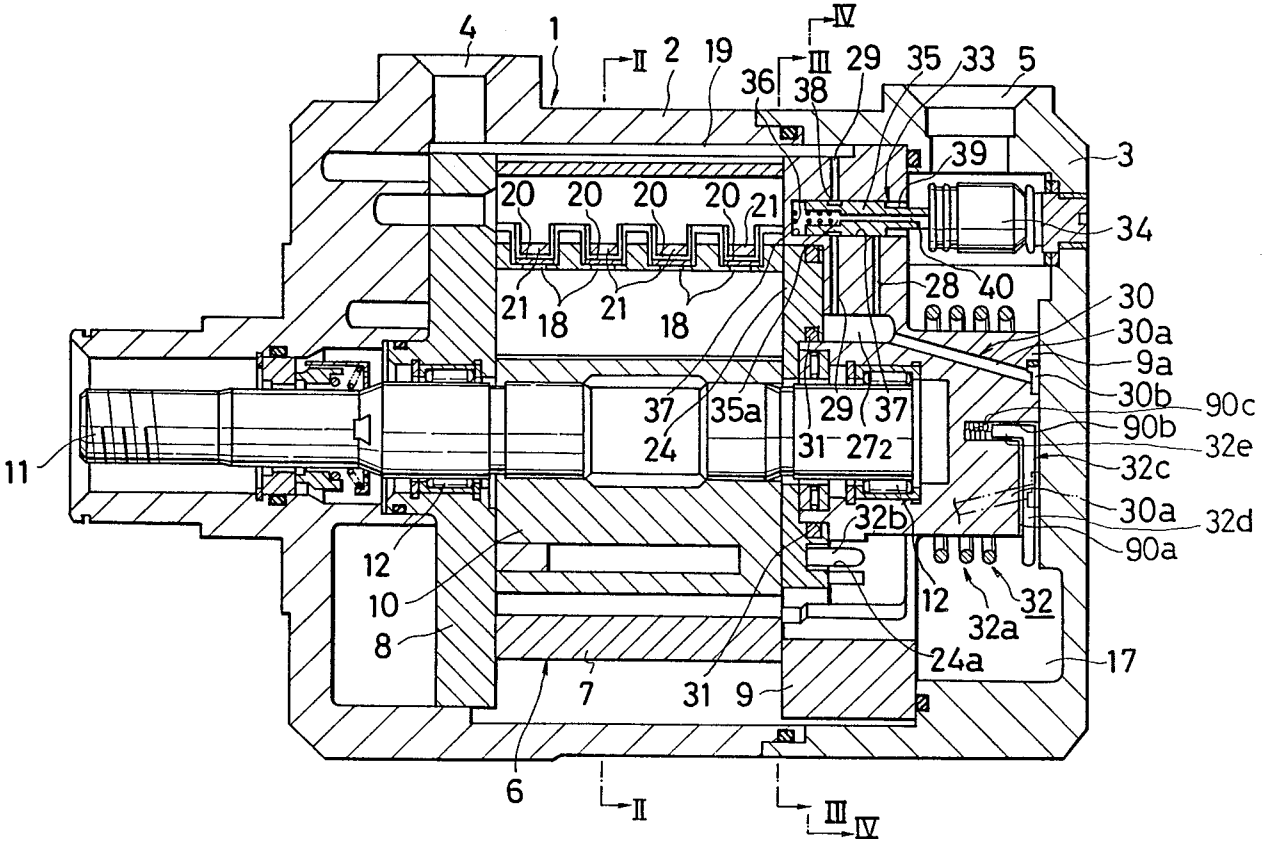
FIG. 1 is a longitudinal cross-sectional view of a variable capacity vane compressor according to a first embodiment of the invention.

The invention will now be described in detail with reference to the drawings showing embodiments thereof.

FIGS. 1 through 8 show a variable capacity vane compressor according to a first embodiment of the invention, wherein a housing 1 comprises a cylindrical casing 2 with an open end, and a rear head 3, which is fastened to the casing 2 by means of bolts, not shown, in a manner closing the open end of the casing 2. A discharge port 4, through which a refrigerant gas is to be discharged as a thermal medium, is formed in an upper wall of the casing 2 at a front end thereof, and a suction port 5, through which the refrigerant gas is to be drawn into the compressor, is formed in an upper portion of the rear head 3. The discharge port 4 and the suction port 5 communicate, respectively, with a discharge pressure chamber 19 and a suction chamber 17, both hereinafter referred to.

A pump body 6 is housed within the housing 1. The pump body 6 is composed mainly of a cylinder formed by a cam ring 7, and a front side block 8 and a rear side block 9 closing open opposite ends of the cam ring 7, a cylindrical rotor 10 rotatably received connected to an engine, not shown, of a vehicle or the like, and on which is secured the rotor 10. The driving shaft 11 is rotatably supported by a pair of radial bearings 12 provided in the side blocks 8 and 9, respectively.

Figure 2:
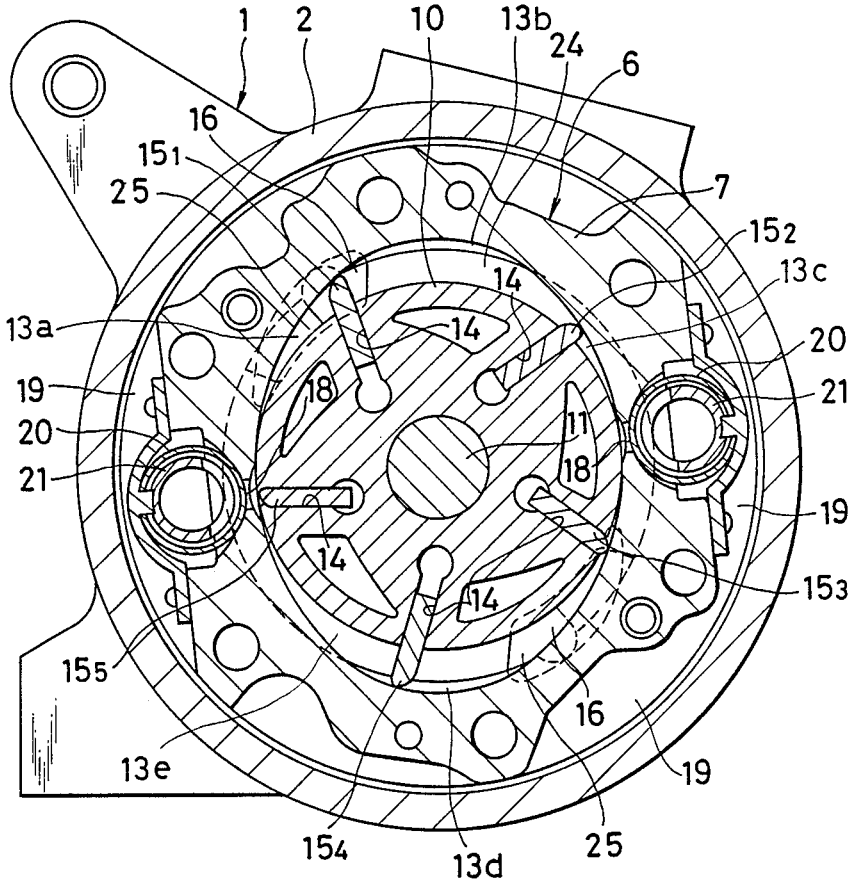
FIG. 2 is a transverse cross-sectional view taken along line II—II in FIG. 1.

The cam ring 7 has an inner peripheral surface with an elliptical cross section, as shown in FIG. 2, and cooperates with the rotor 10 to define therebetween a pair of spaces 13 and 13 at diametrically opposite locations.

The rotor 10 has its outer peripheral surface formed with a plurality of (five in the illustrated embodiment) axial vane slits 14 at circumferentially equal intervals, in each of which a vane $15_1$–$15_5$ is radially slidably fitted. Adjacent vanes $15_1$–$15_5$ define therebetween five compression chambers **13*a*–13*e* in cooperation with the cam ring 7, the rotor 10, are the opposite inner end faces of the front and rear side blocks 8, 9**.

Figure 3:
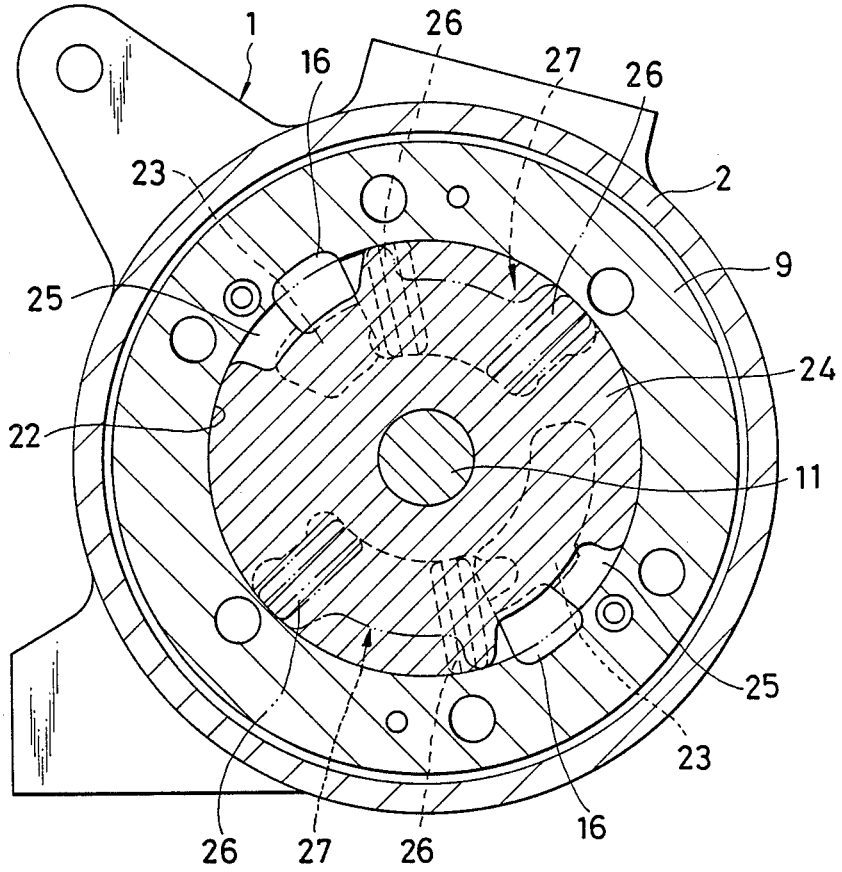
FIG. 3 is a transverse cross-sectional view taken along line III—III in FIG. 1.

Refrigerant inlet ports 16 and 16 are formed in the rear side block 9 at diametrically opposite locations as shown in FIGS. 2 and 3. These refrigerant inlet ports 16, 16 are located at such locations that they become closed when the respective compression chambers **13*a*–13*e* assume the maximum volume. These refrigerant inlet ports 16, 16 axially extend through the rear side block 9 and through which a suction chamber (lower pressure chamber) 17 defined in the rear head 3 by the rear side block 9 and the space 13 or compression chamber 13*a*** on the suction stroke are communicated with each other.

Refrigerant outlet ports 18 are formed through opposite lateral side walls of the cam ring 7 and through which spaces 13 or compression chambers **13*c* and 13*e* on the discharge stroke are communicated with the discharge pressure chamber (higher pressure chamber) 19 defined within the casing 2, as shown in FIGS. 1 and 2. These refrigerant outlet ports 18 are provided with respective discharge valves 20 and valve retainers 21, as shown in FIG. 2**.

Figure 4:
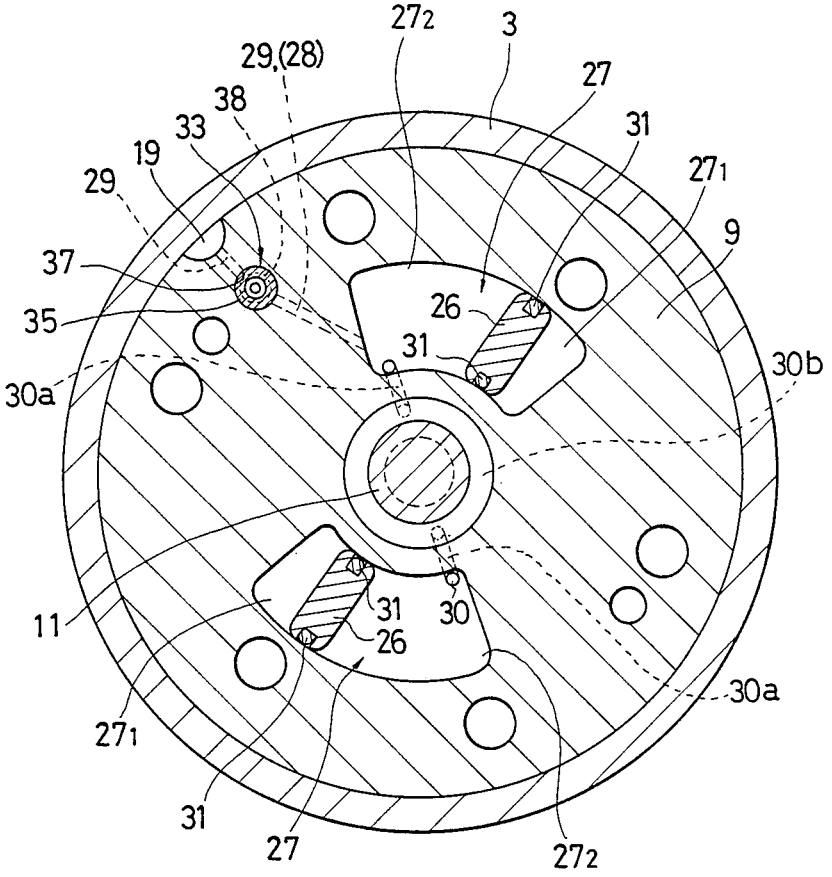
FIG. 4 is a transverse cross-sectional view taken along line IV—IV in FIG. 1.
Figure 5:
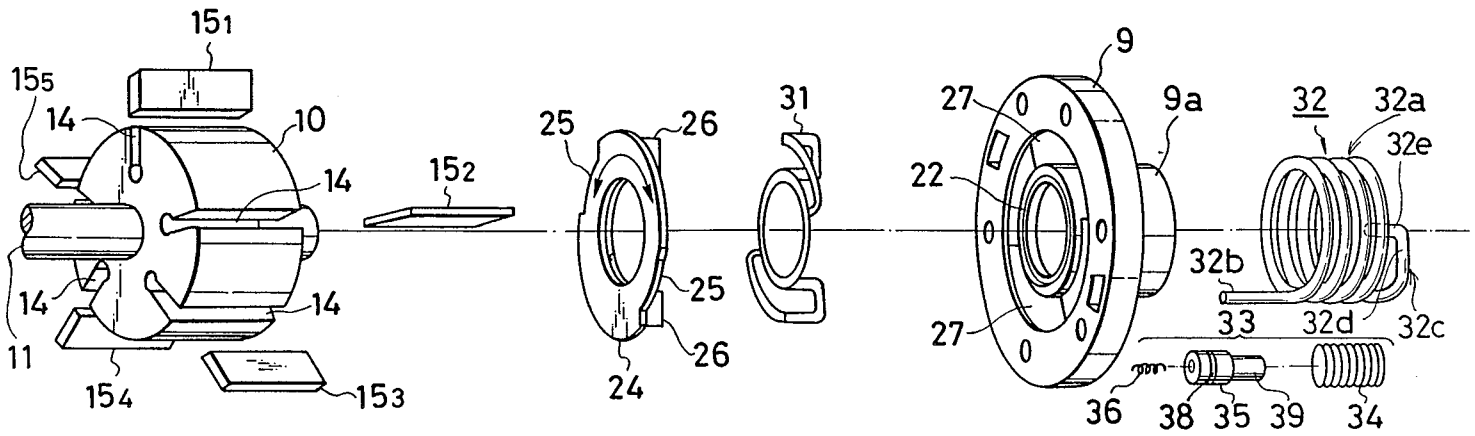
FIG. 5 is an exploded perspective view showing essential parts of the vane compressor of FIG. 1.

The rear side block 9 has an end face facing the rotor 10, in which is formed an annular recess 22 larger in diameter than the rotor 10, as shown in FIGS. 3 and 5. A pair of second inlet ports 23 and 23 in the form of arcuate openings are formed in the rear side block 9 at diametrically opposite locations and circumferentially extend continuously with the annular recess 22 along its outer periphery, as best shown in FIG. 3, and through which the suction chamber 17 is communicated with the compression chamber **13*a* on the suction stroke. An annular control element 24 is received in the annular recess 22 for rotation in opposite circumferential directions to control the opening angle of the second inlet ports 23, 23. The control element 24 has its outer peripheral edge formed with a pair of diametrically opposite arcuate cut-out portions 25 and 25, and its one side surface formed integrally with a pair of diametrically opposite partition plates 26 and 26 axially projected therefrom and acting as pressure-receiving elements. The partition plates 26, 26 are slidably received in respective arcuate spaces 27 and 27 which are formed in the rear side block 9 in a manner continuous with the annular recess 22 and circumferentially partially overlapping with the respective second inlet ports 23, 23. The interior of each of the arcuate spaces 27, 27 is divided into first and second pressure chambers $27_1$ and $27_2$ by the associated partition plate 26. The first pressure chamber $27_1$ communicates with the suction chamber 17 through the corresponding inlet port 16 and the corresponding second inlet port 23, and the second pressure chamber $27_2$ communicates with the discharge pressure chamber 19 and the suction chamber 17 through a low-pressure passage 28 and a high-pressure passage 29 formed in the rear side block 9, as shown in FIGS. 1 and 4. The two chambers $27_2$, $27_2$ are communicated with each other by way of a communication passage 30. The communication passage 30 comprises a pair of communication channels 30*a*, 30*a* formed in a boss 9*a* projected from a central portion of the rear side block 9 at a side remote from the rotor 10, and an annual space 30*b* defined between a projected end face of the boss 9*a* and an inner end face of the rear head 3, as shown in FIGS. 1 and 4. The communication passages 30*a*, 30*a* are arranged symmetrically with respect to the center of the boss 9*a*. Respective ends of the communication passages 30*a*, 30*a* are communicated with the respective second pressure chambers $27_2$, $27_2$, and the other respective ends are communicated with the annual space 30*b***.

A sealing member 31 of a special configuration as shown in FIG. 5 is mounted in the control element 24 and disposed along an end face of its central portion and radially opposite end faces of each pressure-receiving protuberance 26, to seal in an airtight manner between the first and second pressure chambers $27_1$ and $27_2$, as well as between the end face of the central portion of the control element 24 and the inner peripheral edge of the annular recess 22 of the rear side block 9, as shown in FIG. 1.

Figure 8:
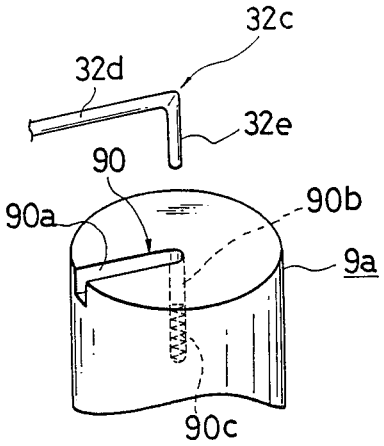
FIG. 8 is a perspective view showing engagement of an end of a torsion coiled spring with a hub according to the first embodiment.

The control element 24 is elastically urged in such a circumferential direction as to increase the opening angle of the second inlet ports 23, i.e. in the counterclockwise direction as viewed in FIG. 3, by a torsion coiled spring 32 fitted around a hub **9*a* of the front side block 9 axially extending toward the suction chamber 17. The torsion coiled spring has a coiled body 32*a* with its loops being spaced from each other, as shown in FIG. 1. The inner diameter of the coiled body 32*a* is substantially larger than the outer diameter of the hub 9*a*. The torsion coiled spring 32 has an end 32*b* thereof engaged in an engaging hole 24*a* which is formed in an end face of the control element 24. The other end 32*c* of the torsion coiled spring 32 is formed by a straight portion 32*d* radially extending to the center of the coiled body 32*a*, and an axial tip portion 32*e* axially bent at right angles with respect to the stra-ight portion 32*d*, as shown in FIG. 8. The hub 9*a* has an end face thereof remote from the rotor 10, which is formed with a retaining means 90 for holding the end 32*c* of the torsion coiled spring 32. The retaining means 90 is formed of a groove 90*a* radially extending from a peripheral edge of the end face of the hub 9*a* to the diametrical center or axis c2 of the hub 9*a* and holding the straight portion 32*d* fitted therein, and a hole 90*b* axially extending continuously with the groove 90***a* and holding the axial tip portion 32*e* of the spring 32. A coiled spring 90*c* is arranged within the hole 90*b*. The projected end face of the hub 9*a* is disposed in contact with the inner end face of the rear head 3, the latter serving as holding means to hold the portions 32*d*, 32*e* of the torsion coiled spring 32 engaged within the respective groove 90*a* and hole 90*b* of the hub 9*a*.

Arranged across the low-pressure and high-pressure communication passages 28, 29 is a control valve device 33 for selectively closing and opening them, as shown e.g. in FIG. 1. The control valve device 33 is operable in response to pressure within the sucion chamber 17, and as shown in FIGS. 1 and 5 it comprises a flexible bellows 34 disposed in the suction chamber 17, with its axis extending parallel with that of the driving shaft 11, a spool valve body 35, and a coiled spring 36 urging the spool valve body 35 in its closing direction. When the suction pressure within the suction chamber 17 is above a predetermined value, the bellows 34 is in a contracted state, while when the suction pressure is below the predetermined value, the bellows 34 is in an expanded state. The spool valve body 35 is slidably fitted in a valve bore 37 formed in the rear side block 9 and extending across the low-pressure communication passage 28 and the high-pressure communication passage 29. The spool valve body 35 has an annular groove 38 formed in its outer peripheral surface closer to an end remote from the bellows 34, and has a thinned end portion 39 with a small diameter substantially equal to the inner diameter of the annular groove 38 at a location closer to the bellows 34. The spool valve body 35 also has an axial internal passage 40 formed therethrough along its axis. The coiled spring 36 is interposed between a seating surface 35*a* formed in an end face of the spool valve body 35 remote from the bellows 34 and an opposed end face of the valve bore 37. The other end face of the spool valve body 35 is in urging contact with an opposed end face of the bellows 34. When the pressure within the suction chamber 17 is above the predetermined value and the bellows 34 is contracted, the annular groove 38 of the spool valve body 35 is aligned with the high-pressure communication passage 29 to open the passage 29, and at the same time the low-pressure communication passage 28 is blocked by the peripheral wall of the spool valve body 35. When the pressure within the suction chamber 17 is less than the predetermined value and the bellows 34 is expanded, the high-pressure communication passage 29 is blocked by the peripheral wall of the spool valve body 35, and at the same time the low-pressure communication passage 28 is aligned with the thinned portion 39 of the spool valve body 35 to open the low-pressure communication passage 28. The pressure within the suction chamber 17 acts on the end face of the spool valve body 35 close to the coiled spring 36 by way of the passage 40, as well as on the other end face of the spool valve body 35. Therefore, the spool valve body 35 is only subject to sliding friction during the displacement thereof, thereby undergoing a very small hysteresis between the time of movement in one direction and that in the opposite direction. Further, the spool valve body 35 and the bellows 34 are separably in contact with each other, there being no fear of breakage of them due to vibration or the like.

Although, in the illustrated embodiment, the low-pressure communication passage 28 is opened and simultaneously the high-pressure communication passage 29 is closed, and vice versa, it may be so arranged that the high-pressure communication passage 29 is opened with a time lag after the low-pressure communication passage 28 is closed when the pressure within the suction chamber 17 rises above the predetermined value, and/or the low-pressure communication passage 28 is opened with a time lag after the high-pressure communication passage 29 is closed when the pressure within the suction chamber 17 drops below the predetermined value.

The operation of the first embodiment of the invention will now be explained.

As the driving shaft 11 is rotatively driven y a prime mover such as an automotive engine to cause clockwise rotation of the rotor 10 as viewed in FIG. 2, the rotor 10 rotates so that the vanes $15_1$–$15_5$ successively move radially out of the respective slits 14 due to a centrifugal force and back pressure acting upon the vanes and revolve together with the rotating rotor 10, with their tips in sliding contact with the inner peripheral surface of the cam ring 7. During the suction stroke the compression chamber 13*a* defined by adjacent vanes increases in volume so that refrigerant gas as thermal medium is drawn through the refrigerant inlet port 16 into the compression chamber 13*a*; during the following compression stroke the compression chamber 13*c*, 13*e* decreases in volume to cause the drawn refrigerant gas to be compressed; and during the discharge stroke at the end of the compression stroke the high pressure of the compressed gas forces the discharge valve 20 to open to allow the compressed refrigerant gas to be discharged through the refrigerant outlet port 18 into the discharge pressure chamber 19 and then discharged through the discharge port 4 into a heat exchange circuit of an associated air conditioning system, not shown.

During the operation of the compressor described above, low pressure or suction pressure within the suction chamber 17 is introduced into the first pressure chamber $27_1$ of each space 27 through the refrigerant inlet port 16, whereas high pressure or discharge pressure within the discharge pressure chamber 19 is introduced into the second pressure chamber $27_2$ of each space 27 through the high-pressure communication passage 29 or through both the high-pressure communication passage 29 and the communication passage 30. The control element 24 is circumferentially displaced depending upon the difference between the sum of the pressure within the first pressure chamber $27_1$ and the biasing force of the torsion coiled spring 32 (which acts upon the control element 24 in the direction of the opening angle of each second inlet port 23 being increased, i.e. in the counter-clockwise direction as viewed in FIG. 3) and the pressure within the second pressure chamber $27_2$ (which acts upon the control element 24 in the direction in which the above opening angle is decreased, i.e. in the clockwise direction as viewed in FIG. 3), to vary the opening angle of each second inlet port 23 and accordingly vary the timing of commencement of the compression stroke and hence the delivery quantity. When the above difference becomes zero, that is, when the sum of the pressure within the first pressure chamber $27_1$ and the biasing force of the spring 32 becomes balanced with the pressure within the second pressure chamber $27_2$, the circumferential displacement of the control element 24 stops.

Figure 6:
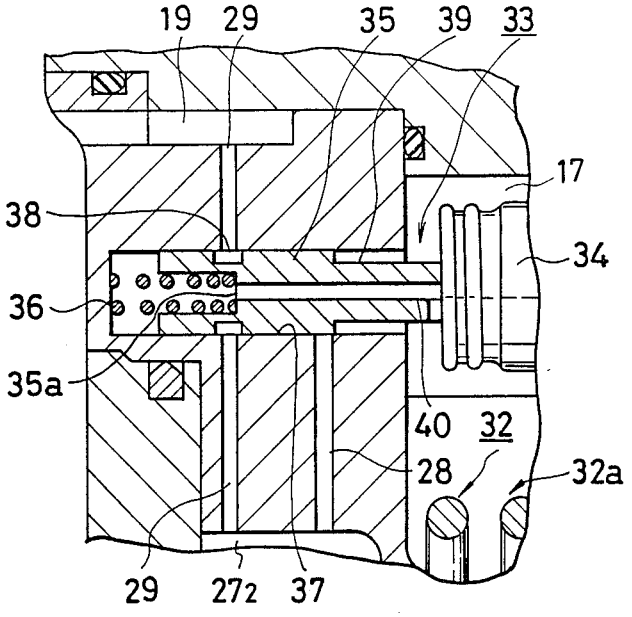
FIG. 6 is an enlarged longitudinal cross-sectional view of a control valve device in a position assumed when the vane compressor of FIG. 1 is at full capacity operation.

For instance, when the compressor is operating at a low speed, the refrigerant gas pressure or suction pressure within the suction chamber 17 is so high that the bellows 34 of the control valve device 33 is contracted to bias the spool valve body 35 to open the high-pressure communication passage 29 and simultaneously block the low-pressure communication passage 28, as shown in FIG. 6. Accordingly, the pressure within the discharge pressure chamber 19 is introduced into the second pressure chamber $27_2$. Thus, the pressure within the second pressure chamber $27_2$ surpasses the sum of the pressure within the first pressure chamber $27_1$ and the biasing force of the torsion coiled spring 32 so that the control element 24 is circumferentially displaced into an extreme position in the clockwise direction as viewedin FIG. 3, whereby the second inlet ports 23, 23 are fully closed by the control element 24 as indicated by the two-dot chain lines in FIG. 3 (the opening angle is zero). Consequently, all the refrigerant gas drawn through the refrigerant inlet port 16 into the compression chamber 13*a* on the suction stroke is compressed and discharged, resulting in the maximum delivery quantity (Full Capacity Operation).

Figure 7:
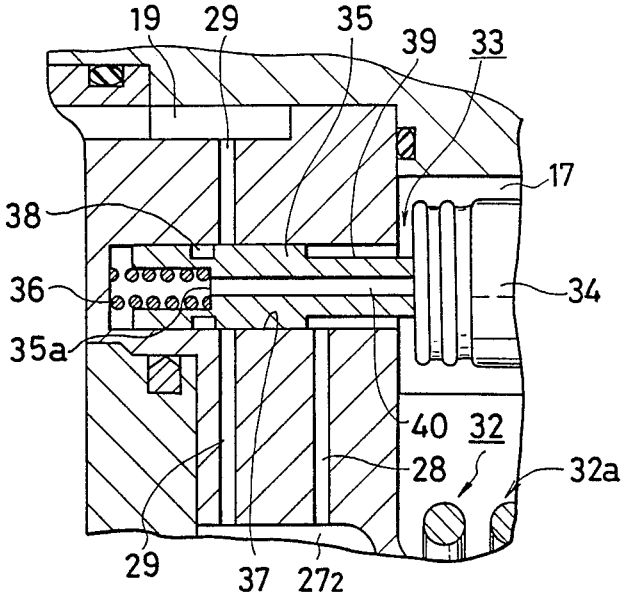
FIG. 7 is a view similar to FIG. 6, wherein the control valve device is in a position assumed when the vane compressor of FIG. 1 is at partial capacity operation.

On the other hand, when the compressor is brought into high speed operation, the suction pressure within the suction chamber 17 is so low that the bellows 34 of the control valve 33 is expanded to urgingly bias the spool valve body 35 against the urging force of the spring 36 to open the low-pressure communication passage 28 and simultaneously block the high-pressure communication passage 29, as shown in FIG. 7. Accordingly, the pressure within the discharge pressure chamber 19 is not introduced into the second pressure chamber $27_2$, and at the same time the pressure within the second pressure chamber $27_2$ leaks through the low-pressure communication passage 28 into the suction chamber 17 in which low or suction pressure prevails to cause a prompt drop in the pressure within the second pressure chamber $27_2$. As a result, the control element 24 is promptly angularly or circumferentially displaced in the counter-clockwise direction as viewed in FIG. 3. When the cut-out portions 25, 25 of the control element 24 thus become aligned with the respective second inlet ports 23, 23 to open the latter, as indicated by the solid lines in FIG. 3, refrigerant gas in the suction chamber 17 is drawn into the compression chambers 13*a* not only through the refrigerant inlet ports 16, 16 but also through the second inlet ports 23, 23. Therefore, the timing of commencement of the compression stroke is retarded by an amount corresponding to the degree of opening of the second inlet ports 23, 23 so that the compression stroke period is reduced, resulting in a reduced amount of refrigerant gas that is compressed and hence a reduced delivery quantity (Partial Capacity Operation).

As previously stated, the coiled body 32*a* of the torsion coiled spring 32 has loops thereof spaced from each other such that the loops are not brought into contact with each other. The end 32*b* of the torsion coiled spring 32 is engaged with the engaging hole 24*a* of the control element 24, while the other end 32*c* of the torsion coiled spring 32 is fitted in the retaining means 90 of the hub 9*a* in a manner that the straight portion 32*d* of the end 32*c* is held between the hub 9*a* and the inner wall of the rear head 3. Furthermore, the straight portion 32*d* is urged by the spring 90*c* against the inner wall of the rear head 3, whereby the end 32*c* is firmly held in the retaining means 90 against shaking.

Since the torsion coiled spring 32 is firmly held as described above, the coiled body 32*a* is prevented from falling into contact with the outer peripheral surface of the hub 9*a*. Therefore, the torsion coiled spring 32 is free from a frictional force which would otherwise be caused by contact of the loops of the coiled body 32*a* with each other or by contact of the coiled body 32*a* with the outer peripheral surface of the hub 9*a* and its other peripheral parts, so that a hysteresis between deformation of the spring 32 toward a tensioned position and resumption of same back to a relaxed position can be reduced.

Althongh in the first embediment described aobve, the high-pressure communication passage 29 is fully closed when the pressure within the suction chamber 17 is lower than a predetermined value, alternatively it may be arranged such that the high-pressure communication passage 29 has its opening area reduced when the pressure within the suction chamber 17 is below the predetermined value.

In FIGS. 9 through 28, corresponding or similar elements or parts to those in FIGS. 1, 5, and 8 are designated by identical reference numerals. FIGS. 1 through 7 showing the first embodiment are also applied to second through eighth embodiments which will be descrihed hereinafter.

Figure 9:
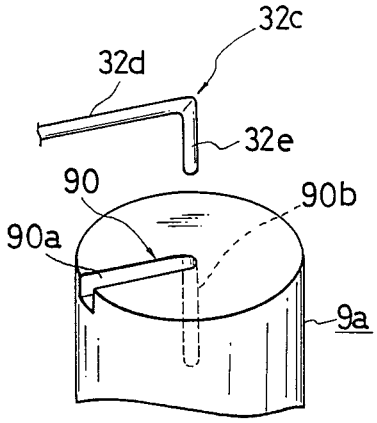
FIG. 9 is a view similar to FIG. 8, showing a second embodiment according to the invention.

FIG. 9 shows a second embodiment of the invention.

The second embodiment is distinguished from the first embodiment only in that the straight portion 32*d* of the end 32*c* of the torsion coiled spring is not urged by the urging spring 90*c* but merely held between the hub 9*a* and the inner wall of the rear head 3.

Figure 10:
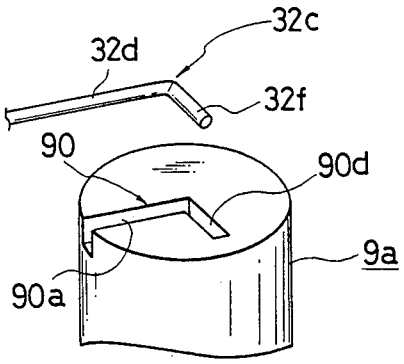
FIG. 10 is a view similar to FIG. 8, showing a third embodiment according to the invention.

FIG. 10 shows a third embodiment of the invention.

In the third embodiment, the end 32*c* of the torsion coiled spring 32 is formed of a straight portion 32*d* radially extending to the neibourhood of the diamerrical center or axis of the hub 9*a*, and a tip portion 32*f* radially extending at right angles with respect to the straight portion 32*d*. The hub 9*a* has a retaining means 90 at an end face remote fromthe rotor 10, which is formed of a groove 90*a* radially extending from a peripheral edge of the end-face of the hub 9*a* to the neibourhood of the diametrical center or axis of the hub 9*a* and holding the straight portion 32*d* fitted therein, and a hole 90*d* radially extending at right angles with respect to the groove 90*a* and holding the tip portion 32*f* of the spring 32 fitted therein.

According to the third embodiment, the end 32*c* of the torsion coiled spring 32 is fitted in the retaining means 90, with the straight portion 32*d* and the tip portion 32*f* being firmly held between the hub 9*a* and the inner wall of the rear head 3, whereby the end 32*c* can be firmly supported without the use of any discrete holding member.

Figure 11:
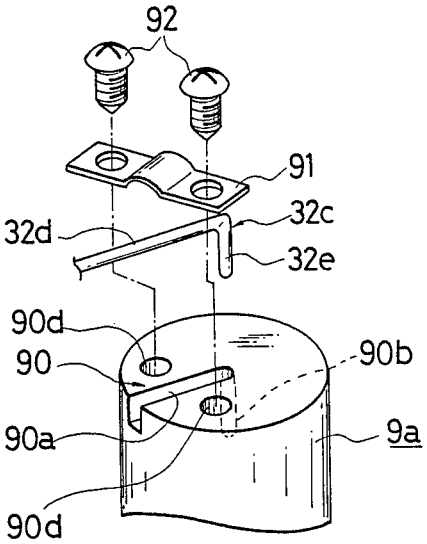
FIG. 11 is a view similar to FIG. 8, showing a fourth embodiment according to the invention.

FIG. 11 shows a fourth embodiment of the invention.

In the fourth embodiment, the end 32*c* of the torsion coiled spring 32 and the retaining means 90 formed in the hub 9*a* are the same in configuration as those of the first embodiment. The end face of the hub 9*a* remote from the rotor 10 has a pair of screw-fitting holes 90*d*, 90*d* formed therein at opposite sides of the groove 90*a* of the retaining means 90. The end 32*c* of the torsion coiled spring 32 is fixed to the end face of the hub 9*a* in such a manner that the straight portion 32*d* of the end 32*c* is retained in the groove 90*a* by a retainer plate 91 which is secured to the end face of the hub 9*a* by means of set screws 92, 92 threadedly fitted in the screw-fitting holes 90*d*, 90*d* through the retainer plate 91.

Figure 12:
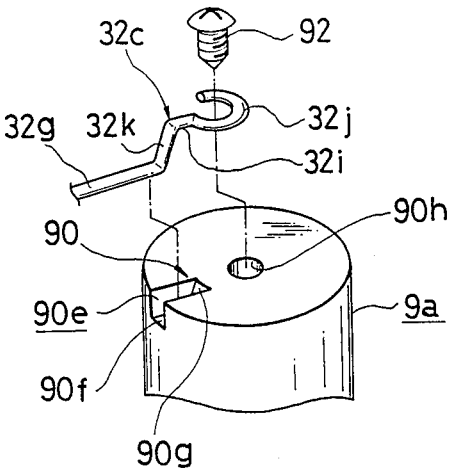
FIG. 12 is a view similar to FIG. 8, showing a fifth embodiment according to the invention.

FIG. 12 shows a fifth embodiment of the invention.

In the fifth embodiment, the retaining means 90 of the hub 9*a* is formed of a groove 9*e* radially extending halfway toward the diametrical center or axis of the hub 9a, and a screw-fitting hole 90h formed in the diametrical center or axis of the end face of the hub 9a. The end 32c of the torsion coiled spring 32 is formed of a first straight portion 32g disposed in contact with a bottom face 90f of the groove 90e, a slant portion 32k extending aslant from the first straight portion 32g and disposed in contact with a slant end face 90g of the groove 90e, a second straight portion 32i extending from the slant portion 32k parallel with the first straight portion 32g and disposed in contact with a flat portion of the end face of the hub 9a, and a hooked tip portion 32j in the form of a semicircle extending from the second straight portion 32i. The end 32c is fixed to the end face of the hub 9a with the hooked tip portion 32j being clamped by a set screw 92 threadedly fitted into the screw-fitting hole 90h through the hooked portion 32j.

Figure 13:
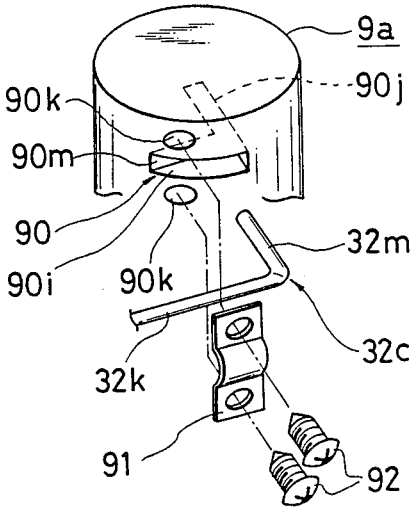
FIG. 13 is a view similar to FIG. 8, showing a sixth embodiment according to the invention.

FIG. 13 shows a sixth embodiment of the invention.

In the sixth embodiment, the retaining means 90 of the hub 9a is formed of a groove 90i formed in the outer peripheral surface of the hub 9a and circumferentially extending with its depth gradually increasing from one end to the other end thereof, a hole 90j radially extending continuously from the other or deeper end of the groove 90i toward the diametrical center or axis of the hub 9a, and a pair of screw-fitting holes 90k, 90k formed in the outer peripheral surface of the hub 9a at opposite sides of the groove 90i. The end 32c of the torsion coiled spring 32 is formed of a straight portion 32k disposed in contact with a bottom face 90m of the groove 90i and a tip portion 32m radially extending toward the diametrical center or axis of the hub 9a at right angles with respect to the straight portion 32k to fit in the groove 90j. The end 32c is fixed to the outer periphery of the hub 9a in such a manner that the straight portion 32k is retained in the groove 90i by a retainer plate 91 which is secured to the outer peripheral surface of the hub 9a by means of set screws 92, 92 threadedly fitted in the screw-fitting holes 90k, 90k through the retainer plate 91.

As described above, according to the first through sixth embodiments, the loops of the torsion coiled spring are sufficiently spaced from each other to thereby be free from contact with each other, and at the same time, the bent end of the torsion coiled spring remote from the rotor is firmly fitted in the retaining means formed in the hub. Therefore, the torsion coiled spring is always stable in position and will not shake into contact with the outer peripheral surface of the hub and/or its peripheral parts, whereby the frictional resistance of the torsion coiled spring caused by the contact and acting upon the control eleent is reduced, thereby improving the capacity controllability of the compressor.

Figure 14:
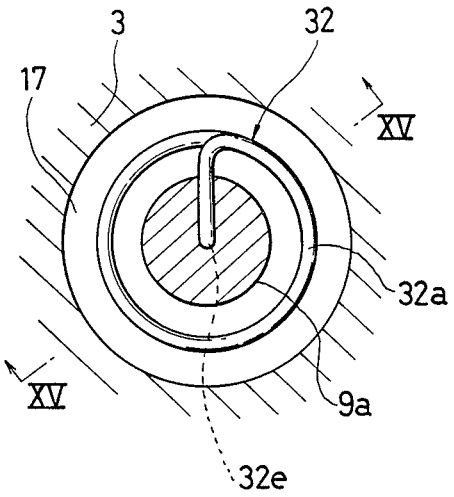
FIG. 14 is a transverse cross-sectional view of the torsion coiled spring according to the first through sixth embodiments, which is in a position assumed when the vane compressor in FIG. 1 is at partial capacity operation.
Figure 15:
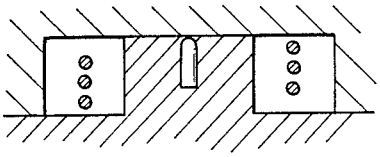
FIG. 15 is a transverse cross-sectional view taken along the line XV—XV of FIG. 14.
Figure 16:
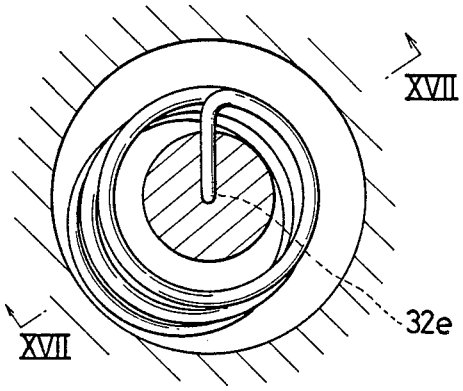
FIG. 16 is a transverse cross-sectional view of the torsion coiled spring according to the first through sixth embodiments, which is in a position assumed when the vane compressor in FIG. 1 is at full capacity operation.
Figure 17:
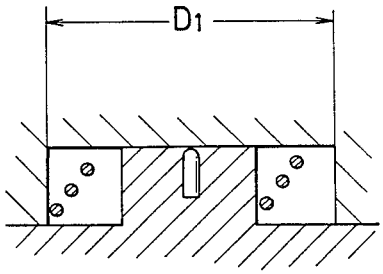
FIG. 17 is a view taken along the line XVII—XVII in FIG. 16.

The torsion coiled spring 32 according to the first and second embodiments has the axial tip portion 32e located at the diametrical center of the end face of the hub 9a such that the diametrical center of the coiled body 32a of the spring 32 is aligned with the axis of the hub 9a, when the control element 24 is in a position where the opening angle of the second inlet ports 23 assumes the maximum value, that is, when the spring 32 is in a relaxed state, as shown in FIGS. 14 and 15. That is, the coiled body 32a is positioned approximately at the middle between the outer peripheral surface of the hub 9a and the inner peripheral surface of the suction chamber 17 in the rear head 3, which is depicted in the form of a circle for facilitating the understanding. As the torsion coiled spring 32 is displaced from a position assumed during the partial capacity operation of the compressor, as shown in FIGS. 14 and 15, toward a position assumed during the full capacity operation of same the torsion coiled spring 32 is radially displaced accordingly by a force caused by the angular displacement of the control element 24. When the torsion coiled spring 32 is radially deformed by a half of the distance between the outer peripheral surface of the hub 9a and the inner peripheral surface of the suction chamber 17, the inner and outer peripheral surfaces of the coiled body 32a are respectively brought into contact with the outer peripheral surface of the hub 9a and the inner peripheral surface of the suction chamber 17 as shown in FIGS. 16 and 17. That is, in the early stage of angular displacement of the control element 24 from the partial capacity operation position where the opening degree of the second inlet ports 23 is larger to the full capacity operation position where the opening degree of same is smaller, the inner and outer peripheral surfaces of the coiled body 32a are respectively brought into contact with the outer peripheral surface of the hub 9a and the inner peripheral surface of the suction chamber, as shown in FIGS. 16 and 17. Then, as the control element 24 is further displaced from the above stage toward the full capacity operation position, the frictional resistance of the coiled spring 32 which is caused by the contact of the coiled spring 32 with the peripheral parts is increased, which causes a hysteresis between deformation of the torsion coiled spring 32 toward its tensioned position and resumption of same back to its relaxed position, so that it becomes difficult to acurately control the control element 24, and hence the compressor. If the size D1 of the inner wall of the rear head 3 is enlarged, it will be possible to avoid the contact of the coiled body 32a of the spring 32 with the hub 9a and the rear head 3. However, this necessitates increase in the overall size of the compressor itself.

Seventh and eighth embodiments according to the present invention, shown in FIGS. 18 through 28, are intended to overcome the above-described disadvantage, wherein the frictional resistance of the torsion coiled spring caused by its contact with the peripheral parts is reduced, thereby improving the capacity controllability of the compressor, without the size of the compressor being enlarged.

FIGS. 18 through 24 show the seventh embodiment.

Figure 18:
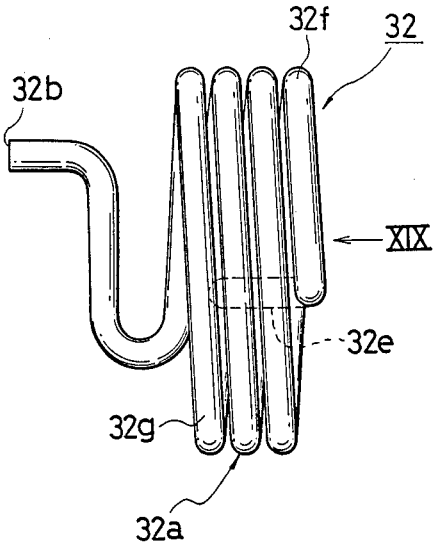
FIG. 18 is a side view of a torsion coiled spring according to a seventh embodiment of the present invention.
Figure 19:
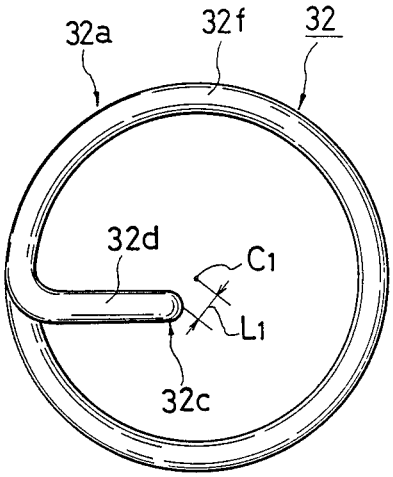
FIG. 19 is an end view of the torsion coiled spring in FIG. 18, viewed from the arrow XIX in FIG. 18.
Figure 20:
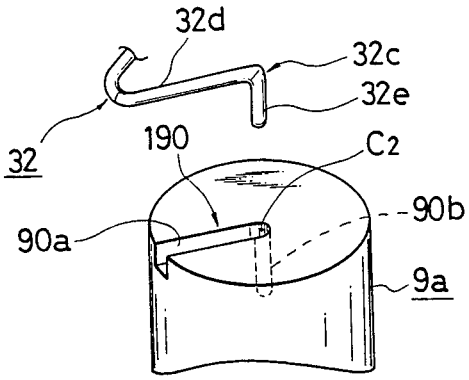
FIG. 20 is a perspective view showing engagement of an end of the torsion coiled spring in FIG. 18 with a hub.

The torsion coiled spring 32 has an axial tip portion 32e radially offset with respect to the axis C1 thereon by a predetermined distance L1, as shown in FIGS. 18 and 19, while the axial hole 90b formed in the hub 9a is located at the axis C2 of the hub 9a , in which the axial tip portion 32e of the spring 32 is fitted. Therefore, when the axial tip portion 32e is fitted in the axial hole 90b, as shown in FIGS. 20 and 22, the axis C1 of the torsion coiled spring 32 is offset with respect to the axis c2 of the hub 9a in a radial direction opposite to the direction of radial deformation of the spring 32 by the distance L1 which preferably corresponds to the maximum amount of radial deformation of the spring 32 caused by the angular displacement of the control element 24, if the control element 24 is in the partial capacity operation position where the second inlet ports 23 assume the maximum opening angle, as shown in FIGS. 21 and 22, wherein the torsion coiled spring 32 is in a relaxed state not acted upon by a force caused by the angular displacement of the control element.

Figure 21:
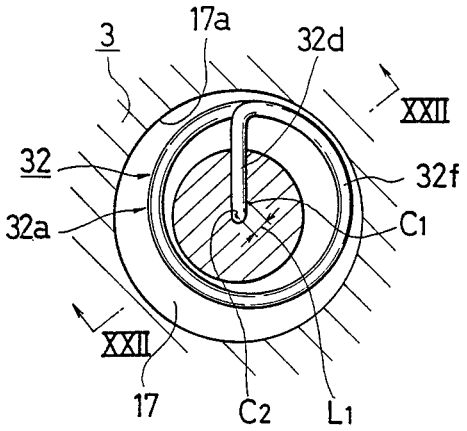
FIG. 21 is a transverse cross-sectional view of the torsion coiled spring according to the seventh embodiment, which is in a position assumed when the vane compressor is at partial capacity operation.
Figure 22:
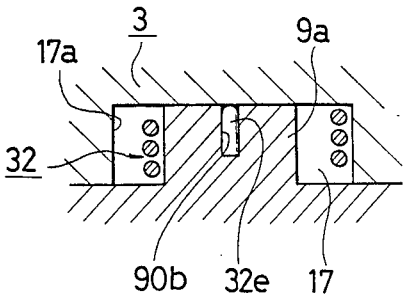
FIG. 22 is a longitudinal cross-sectional view taken along the line XXII—XXII in FIG. 21.

On this occasion, one side part of the peripheries of all the loops of the coiled body 32a (right upper portions of the peripheries in the illustrated embodiment)

are positioned close to the inner wall 17*a* of the suction chamber 17, and at the same time, the opposite side part of the loop peripheries (left lower portions of the loop peripheries in the illustrated embodiment) are positioned close to the outer peripheral surface of the hub 9*a*, as shown in FIGS. 21 and 22. On the other hand, when the control element 24 assumes the full capacity operation position where the torsion coiled spring 32 is radially deformed by the maximum amount by the force caused by the angular displacement of the control element 24, as shown in FIGS. 23 and 24, the one side part or right upper portion of a loop 32*f* at one end of the coiled body 32*a*, i.e. right end as viewed in FIG. 18 and the opposite side part or left lower portion of same are positioned close to the inner wall 17*a* of the suction chamber 17 and the outer peripheral surface of the hub 9*a*, respectively, while at the same time, the opposite side part or left lower portion of a loop 32*g* at the opposite end of the coiled body 32*a*, i.e. left end as viewed in FIG. 18, and the one side part or upper right portion of same are positioned close to the inner wall 17*a* of the suction chamber 17 and the outer peripheral surface of the hub 9*a*, respectively.

The operation of the torsion coiled spring 32 constructed as above according to the seventh embodiment will now be explained.

Figure 23:
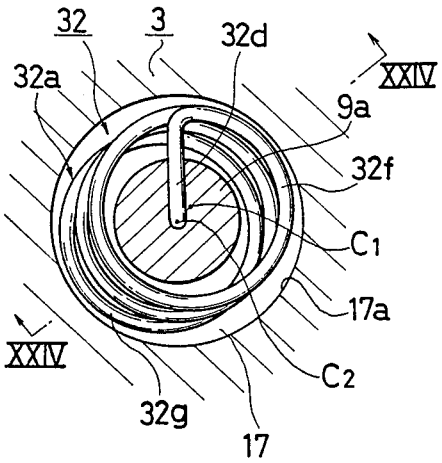
FIG. 23 is a transverse cross-sectional view of the torsion coiled spring according to the seventh embodiment, which is in a position assumed when the vane compressor is at full capacity operation.
Figure 24:
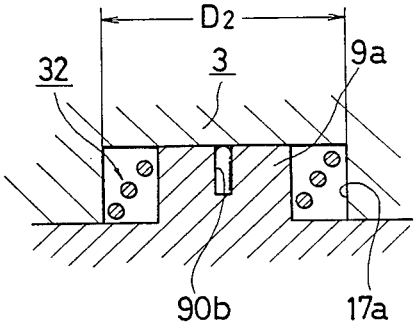
FIG. 24 is a longitudinal cross-sectional view taken along the line XXIV—XXIV in FIG. 23.

When the control element 24 is angularly displaced from the partial capacity operation position to the full capacity operation position to gradually reduce the opening degree of the second inlet ports 23, the torsion coiled spring 32 is gradually deformed from a position corresponding to the partial capacity operation, as shown in FIGS. 21 and 22, toward a position corresponding to the full capacity operation, as shown in FIGS. 23 and 24. During this deformation, the coiled body 32*a* of the spring 32 is free from being brought into contact with the outer peripheral surface of the hub 9*a* and the inner wall 17*a* of the suction chamber 17, whereby the frictional resistance of the torsion coiled spring 32 caused by its contact with the peripheral parts is reduced.

Although in the above embodiment, the torsion coiled spring 32 is arranged such that it is not in contact with the hub 9*a* nor with the inner wall 17*a* of the suction chamber 17 during the full capacity operation, alternatively the distance L1 between the axis of the coiled body 32*a* of the torsion coiled spring 32 and the axial tip portion 32*e* of the end 32*c* of same may be set such that the torsion coiled spring 32 is in contact with the hub 9*a* and the inner wall 17*a* during or near the full capacity operation. According to this alternative arrangement, the timing at which the torsion coiled spring 32 is brought into contact with the peripheral parts is delayed by a time period corresponding to the predetermined distance L1, thereby reducing the frictional resistance of the torsion coiled spring 32 caused by its contact with the peripheral parts.

FIGS. 25 through 28 show an eighth embodiment of the invention.

Figure 25:
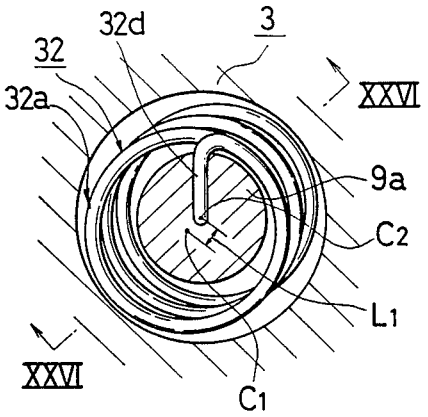
FIG. 25 is a transverse cross-sectional view of a torsion coiled spring according to an eighth embodiment, which is in a position assumed when the vane compressor is at partial capacity operation.
Figure 26:
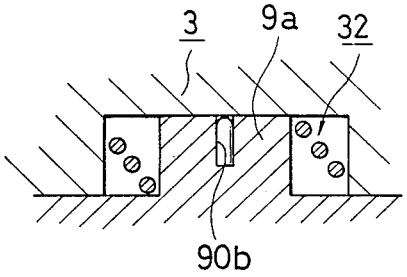
FIG. 26 is a longitudinal cross-sectional view taken along the line XXVI—XXVI in FIG. 25.
Figure 27:
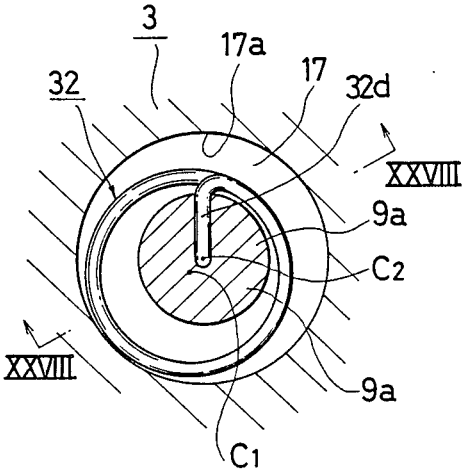
FIG. 27 is a transverse cross-sectional view of the torsion coiled spring according to the eighth embodiment, which is in a position assumed when the vane compressor is at full capacity operation.
Figure 28:
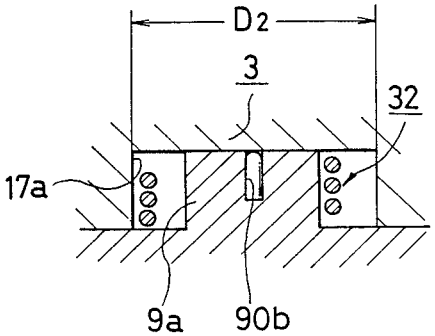
FIG. 28 is a longitudinal cross-sectional view taken along the line XXVIII—XXVIII in FIG. 27.

While in the seventh embodiment described above, the torsion coiled spring 32 is arranged in such a manner that it is relaxed in a straight shape during the partial capacity operation, and it is fully deformed during the full capacity operation, in the eighth embodiment, the torsion coiled spring 32 is arranged such that it is previously biased by a pre-loading spring member, not shown, so as to be fully deformed during the partial capacity operation, as shown in FIGS. 25 and 26, while it becomes straight-shaped during the full capacity operation, due to a force caused by the angular displacement of the control element 24, as shown in FIGS. 27 and 28. The other construction of the eighth embodiment is substantially identical with that of the seventh embodiment.

As described above, according to the seventh and eighth embodiments, since the frictional resistance of the torsion coiled spring caused by its contact with the peripheral parts as well as the frictional resistance of same caused by contact of the loops with each other is reduced, the hysteresis between deformation of the coiled spring toward its tensioned position and resumption of same back to its relaxed position is reduced even without the inner diameter D2 of the inner wall 17*a* of the suction chamber 17 shown in FIG. 24 being enlarged. As a result, the inner diameter D2 of the suction chamber 17 can be made smaller than the conventional inner diameter 1 in FIG. 17, thereby making it possible to make the compressor more compact in size.

Although in the above seventh and eighth embodiments, the axial tip portion 32*e* of the torsion coiled spring 32 is positioned offset by a predetermined distance L1 with respect to the diametrical center of the coiled body 32*a* of the spring 32, and at the same time, the hole 90*b* is formed in the end face of the hub 9*a* at the diametrical center C2, a similar effect can be obtained by an altermative arrangement that the axial tip portion 32*e* is positioned at the diametrical center of the coiled body 32*a*, and at the same time, the hole 90*b* is formed in the end face of the hub 9*a* offset by a predetermined distance L1 with respect to the diametrical center C2 of the hub 9*a*.

Figure 29:
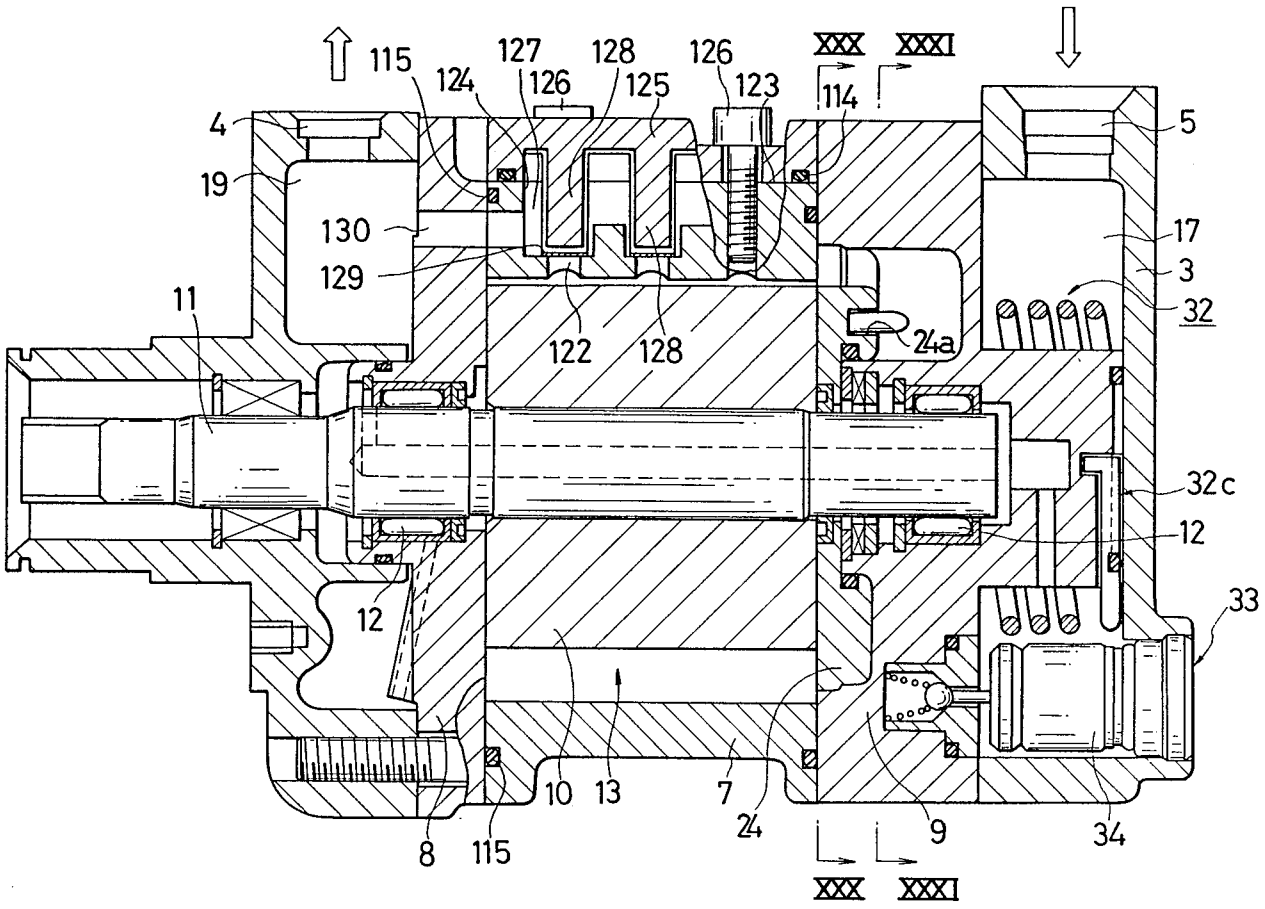
FIG. 29 is a longitudinal cross-sectional view of a variable capacity vane compressor according to a ninth embodiment of the invention.
Figure 30:
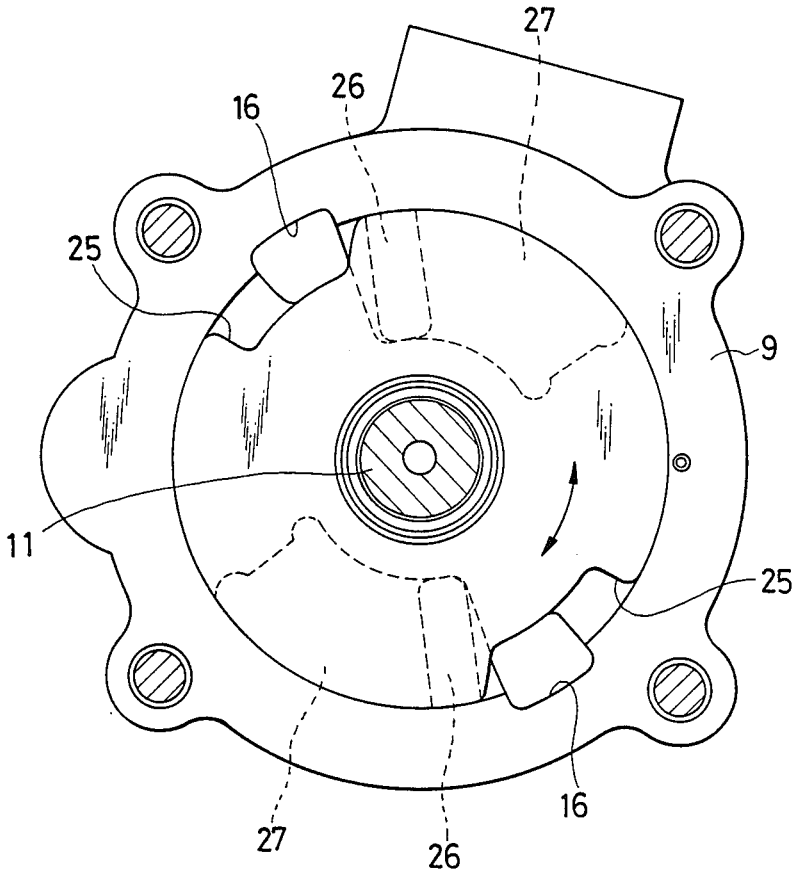
FIG. 30 is a transverse cross-sectional view taken along line XXX—XXX in FIG. 29.
Figure 31:
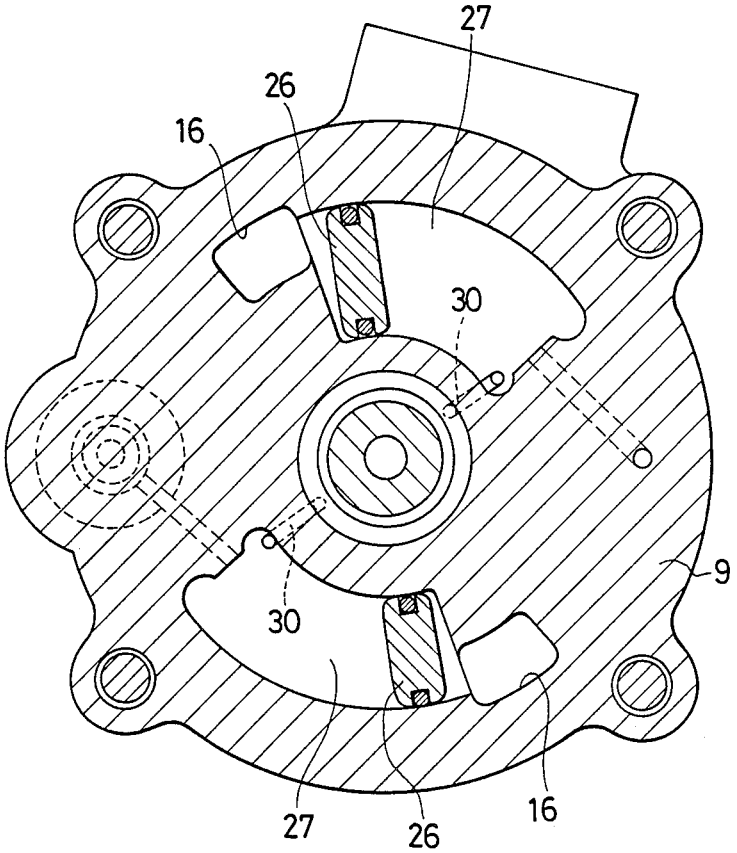
FIG. 31 is a transverse cross-sectional view taken along line XXXI—XXXI in FIG. 29.

FIGS. 29 through 31 show a ninth embodiment of the invention. A variable capacity compressor of the ninth embodiment is different from the compressor of the first embodiment mainly in that the casing 2 is omitted from the compressor, thereby making the compressor compact in size and reduced in weight. The torsion coiled spring 32 according to the first through eighth embodiments can be applied to the compressor to the ninth embodiment. In FIGS. 29–31, like reference numerals designate elements or parts similar to those in FIGS. 1, 3, and 4, and description thereof is omitted.

In FIG. 29, the cam ring 7 forms a casing of the compressor together with the front head 8 and rear head 9. The cam ring 7 has e.g. two sets of refrigerant outlet ports 122, 122 (only one set of which is shown) formed through a peripheral wall thereof and arranged at circumferentially opposite locations with respect to the axis of the compressor. The refrigerant outlet ports 122, 122 have one end thereof opening into spaces 13, 13 in the neibourhood of portions with reduced diameter of the peripheral wall of the cam ring 7. Onter peripheral surface portions 123, 123 of the cam ring 7 formed with the refrigerant outlet ports 122, 122 are cut in the form of flat surfaces for mounting covers 125, 125 thereon (only one of the surfaces is shown). The cover-mounting portions 123, 123 have respective recesses 124, 124 (only one of which is shown) formed therein which each have e.g. three circumferantially extending grooves with arcuate bottom surfaces formed therein. The regrigerant outlet ports 122, 122 have other ends thereof opening into the respective recesses 124, 124.

The covers 125, 125 (one of which is shown) are screwed respectively to the cover-mounting portions 123, 123 of the cam ring 7 by means of e.g. four mounting bolts 126 (two of which are shown). O-rings 114 are interposed between the covers 125, 125 and the cover-mounting portions 123, 123 of the cam ring 7, to maintain airtightness between the recesses 124, 124 and the outside. The covers 125, 125 have respective arcuate recesses formed in inner peripheral surfaces thereof, which form spaces 127, 127 for accommodating discharge valves 129, 129 (one of the spaces is shown), together with the recesses 124, 124 of the cam ring 7. The covers 125, 125 have six stopper portions 128 (two of which are shown) projecting integrally therefrom toward the cam ring 7 and opposed to the respective refrigerant outlet ports 122.

In the spaces 127, 127, the discharge valves 129, 129 (one of which is shown) are arranged as is known from Japanese Utility Model Publication (Kokai) No. 62-132289. The discharge valves 129, 129 are formed of a single elastic sheet member rolled in a form of cylinder. The cylinder has a slit, not shown, axially extending therethrough and resiliently fit and secured on an axial ridge, not shown, formed on the inner surface of the cover 125, thus being supported by the latter.

The discharge valves 129, 129 have cylindrical end faces thereof in contact with the other ends of the respective regrigerant outlet ports 122, thereby closing the ports 122 except during the discharge stroke of the compressor.

The discharge pressure chamber 19 and the discharge valve-accommodating spaces 127, 127 are communicated with each other through communicating passages 130, 130 (one of which is shown) formed in the cam ring 7 and the front side block 8. Respective ends of the passages 130, 130 opening into the spaces 127, 127 are arranged radially inwardly of an O-ring 115 which is interposed between the cam ring 7 and the front side block 8 for maintaining airtightness between the communicating passages 130, 130 and the outside.

With the above construction, during the discharge stroke, the discharge valves 129, 129 are urgedly deformed by the force of compressed regrigerant gas until they are brought into contact with the stopper portions 128, whereby the compressed gas is discharged into the spaces 127, 127. The gas discharged into the spaces 127, 127 is then delivered into the discharge pressure chamber 19 through the communicating passages 130, 130, and then discharged out of the compressor through the discharge port 4.

As described above, according to the ninth embodiment of the invention, the recesses 124, 124 into which the refrigerant outlet ports 122, 122 open are formed in the outer peripheral surface of the cam ring 7, the covers 125, 125 are mounted on the cam ring so as to cover the respective recesses 124, 124, whereby the spaces 127, 127 are formed between the cam ring 7 and the covers 125, 125, in which the discharge valves 129, 129 are arranged, and the communicating passages 130, 130 are formed in the cam ring 7 and the side block to communicate with the spaces 127, 127 with the dischange pressure chamber 19. The casing of the compressor is thus omitted, thereby making the compressor compact in size and reduced in weight. Further, also the compressor of the ninth embodiment has improved capacity controllability by virtue of employment of the torsion coiled spring 32 as employed in the first through eighth embodiments.

What is claimed is:

1. A variable capacity vane compressor comprising:

a cylinder formed by a cam ring and a pair of front and rear side blocks respectively closing opposite axial ends of said cam ring, one of said front and rear side blocks having at least one inlet port, said at least one inlet port having a first portion and a second portion, said one side block having a recess formed therein and a hub extending integrally from an end face thereof;

a rotor rotatably received within said cylinder;

a plurality of vanes radially slidably fitted in slits formed in said rotor;

a zone under low pressure;

a zone under high pressure;

said cylinder, said rotor and adjacent ones of said vanes cooperating with each other to define therebetween a plurality of compression chambers which vary in volume, as said rotor rotates, so that a compression medium is drawn into at least one of said compression chambers which is on a suction stroke from said zone under low pressure chamber through said at least one inlet port, and the drawn medium is compressed within at least one of said compression chambers which is on a compressor stroke and is discharged therefrom;

said second portion of said at least one inlet port communicating with said zone under low pressure and at least one of said compression chambers which is on a suction stroke;

at least one space provided in said one side block and communicating with said zone under low pressure and said zone under high pressure;

a control element angularly displaceably fitted in said recess for controlling the opening angle of said second portion of said at least one inlet port;

said control element having a pressure receiving portion slidably fitted in said at least one space and dividing said space into a first pressure chamber communicating with said zone under low pressure and a second pressure chamber communicating with both said zone under low pressure and said zone under high pressure;

a torsion coiled spring fitted around said hub of said one side block for biasing said control element in an angular direction of increasing the opening angle of said second portion of said at least one inlet port;

said control element being angularly displaceable in response to a difference between the sum of pressure in said first pressure chamber and the force of said torsion coiled spring and pressure in said second pressure chamber for causing said control element to vary the opening angle of said second portion of said at least one inlet port, to thereby cause a change in the timing of commencement of the compression of the compression medium and hence vary the capacity of the compressor;

said torsion coiled spring having one end thereof provided with a first engaging portion, and another end thereof provided with a second engaging portion;

first retaining means provided in said control element and engaging said first engaging portion of said torsion coiled spring;

second retaining means provided at said hub of said one side block and engaging said second engaging portion of said torsion coiled spring; and holding means for holding said second engaging portion of said torsion coiled spring engaging said second retaining means;

said second engaging portion of said torsion coiled spring comprising a first portion and a second portion extending at a predetermined angle with respect to said first portion and forming a tip of said torsion coiled spring, said first and second portions presenting together a bent portion;

said second retaining means of said hub comprising a first retaining portion engaging said first portion of said second engaging portion of said torsion coiled spring, and a second retaining portion extending at a predetermined angle with respect to said first retaining portion and engaging said second portion of said second engaging portion of said torsion coiled spring.

2. A variable capacity vane compressor as claimed in claim 1, wherein said first portion of said second engaging portion of said torsion coiled spring comprises a radial straight portion, said second portion of said torsion coiled spring comprising an axial straight portion extending substantially at right angles with respect to said radial straight portion.

3. A variable capacity vane compressor as claimed in claim 1, wherein said first retaining portion of said second retaining means of said hub comprises a first radial groove formed in said hub at an end face thereof remote from said rotor, and a second radial groove formed in said end face of said hub and continuously extending substantially at right angles with respect to said first radial groove, said first radial groove and said second radial groove engaging said first portion of said second engaging portion of said torsion coiled spring and said second portion of same, respectively.

4. A variable capacity vane compressor as claimed in claim 1, wherein said second retaining means of said hub comprises a groove formed in said hub at an end face remote from said rotor and radially extending halfway toward a diametrical center of said end face, said groove having a slant end face close to the diametrical center of said end face of said hub, and a central hole formed in said end face of said hub at the diametrical center thereof, said holding means comprising screw means, said first portion of said second engaging portion of said torsion coiled spring comprising a first straight portion radially extending halfway toward the diametrical center of said hub and disposed in contact with a bottom face of said groove, said second portion of said second engaging portion comprising a slant portion extending continuously with said first straight portion and disposed in contact with said slant end face of said groove, a second straight portion continuously extending in contact with said end face of said hub, and a hooked tip portion extending continuously with said second straight portion along a perimeter of said central hole, said second engaging portion of said torsion coiled spring being secured to said end face of said hub in a manner such that said hooked tip portion is clamped by said screw means threadedly fitted in said central hole through said hooked tip portion.

5. A variable capacity vane compressor as claimed in claim 1, wherein said second retaining means of said hub comprises a circumferential groove formed in an outer peripheral surface of said hub, and a radial groove formed in the outer peripheral surface of said hub and radially extending continuously substantially at right angles with respect to said circumferential groove, said circumferential groove and said radial groove engaging said first portion of said second engaging portion of said torsion coiled spring and said second portion of same, respectively, said holding means comprising a pair of holes formed in the outer peripheral surface of said hub at opposite sides of said circumferential groove, a pair of screw means, and a holding plate member, said second engaging portion of said torsion coiled spring being secured to the outer peripheral surface of said hub by means of said screw means threadedly fitted in said holes through said holding plate member.

6. A variable capacity vane compressor as claimed in claim 1, wherein said first retaining portion of said second retaining means of said hub comprises a radial groove formed in said hub at an end face thereof remote from said rotor, said second retaining portion of same comprising an axial hole extending continuously with said radially extending groove.

7. A variable capacity vane compressor as claimed in claim 6, further including urging means urging said second portion of said second engaging portion of said torsion coiled spring.

8. A variable capacity vane compressor as claimed in claim 7, including a stationary member arranged adjacent said hub and having a face opposed to said end face of said hub remote from said rotor, said holding means comprising said face of said member.

9. A variable capacity vane compressor as claimed in claim 8, wherein said stationary member is a rear head.

10. A variable capacity vane compressor as claimed in claim 6, wherein said holding means comprises a pair of holes formed in said end face of said hub at opposite sides of said radial groove, a pair of screw means and a holding plate member, said second engaging portion of said torsion coiled spring being secured to said end face of said hub by means of said screw means threadedly fitted, respectively, in said holes through said holding plate member.

11. A variable capacity vane compressor as claimed in claim 6, including a stationary member arranged adjacent said hub and having a face opposed to said end face of said hub remote from said rotor, said holding means omprising said face of said member.

12. A variable capacity vane compressor as claimed in claim 11, wherein said stationary member is a rear head.

13. A variable capacity vane compressor as claimed in claim 1, further including radially offsetting means engaging said second engaging portion of said torsion coiled spring with said second retaining means of said hub in a manner such that a diametrical center of said torsion coiled spring is radially offset with respect to an axis of said hub by a predetermined distance in a radial direction opposite to a direction of radial deformation of said torsion coiled spring caused by an angular displacement of said control element, when said control element is in predetermined one of a position corresponding partial capacity operation of said compressor and a position corresponding to full capacity operation of said compressor.

14. A variable capacity vane compressor as claimed in claim 13, wherein said first portion of said second engaging portion of said torsion coiled spring comprises a straight portion, said second portion of same comprising an axial tip portion radially offset with respect to the diametrical center of said torsion coiled spring, said second retaining portion of said second retaining means of said hub comprising an axial hole formed in said hub at an end face thereof remote from said rotor at the axis of said hub, said axial tip portion of said torsion coiled spring being fitted in said axial hole, said radially offsetting means comprising said axial tip portion of said torsion coiled spring and said axial hole in said hub.

15. A variable capacity vane compressor as claimed in claim 13, wherein said torsion coiled spring is arranged such that it is in a straight form when said control element is in said position corresponding to partial capacity operation of said compressor, while it is radially fully deformed when said control element is in said position corresponding to full capacity operation of said compressor.

16. A variable capacity vane compressor as claimed in claims 13, wherein said torsion coiled spring is arranged such that it is in a straight form when said control element is in said position corresponding to full capacity operation of said compressor, while it is radially fully deformed when said control element is in said position corresponding to partial capacity operation of said compressor.

* * * * *